US011445772B2

(12) United States Patent
Singh et al.

(10) Patent No.: US 11,445,772 B2
(45) Date of Patent: Sep. 20, 2022

(54) PERSONAL PROTECTIVE MASK

(71) Applicants: Shane Shiva Singh, Wellington, FL (US); Shihao Zhang, Jacksonville, FL (US); Shivkumar Kaushik Murthy, Orlando, FL (US); Akash Kalpesh Gajjar, Rockledge, FL (US)

(72) Inventors: Shane Shiva Singh, Wellington, FL (US); Shihao Zhang, Jacksonville, FL (US); Shivkumar Kaushik Murthy, Orlando, FL (US); Akash Kalpesh Gajjar, Rockledge, FL (US)

(73) Assignee: S Star Technologies LLC, Wellington, FL (US)

( * ) Notice: Subject to any disclaimer, the term of this patent is extended or adjusted under 35 U.S.C. 154(b) by 686 days.

(21) Appl. No.: 16/377,006

(22) Filed: Apr. 5, 2019

(65) Prior Publication Data

US 2019/0307185 A1 Oct. 10, 2019

Related U.S. Application Data

(60) Provisional application No. 62/652,961, filed on Apr. 5, 2018.

(51) Int. Cl.
*A41D 13/11* (2006.01)

(52) U.S. Cl.
CPC ..... *A41D 13/1115* (2013.01); *A41D 13/1176* (2013.01); *A41D 2400/38* (2013.01)

(58) Field of Classification Search
CPC ..... A41D 13/11–1192; A41D 2400/38–422; A41D 31/12–125; A62B 18/00; A62B 18/02–025; A62B 18/08; A62B 18/088; A62B 23/00–025
See application file for complete search history.

(56) References Cited

U.S. PATENT DOCUMENTS

| | | | | |
|---|---|---|---|---|
| 4,014,047 | A * | 3/1977 | Zobel | D05B 33/02 128/206.19 |
| 7,036,507 | B2 | 5/2006 | Jensen | |
| 8,342,180 | B2 | 1/2013 | Martin et al. | |
| 8,881,729 | B2 | 11/2014 | Duffy | |
| 10,207,129 | B2 | 2/2019 | Koehler | |
| 10,385,484 | B1 * | 8/2019 | Wyrick | D04B 1/22 |
| 2005/0133034 | A1 | 6/2005 | Jensen | |
| 2006/0130842 | A1 | 6/2006 | Kleman | |
| 2007/0044803 | A1 | 3/2007 | Xue et al. | |

(Continued)

*Primary Examiner* — Rachel T Sippel
(74) *Attorney, Agent, or Firm* — Jason T. Daniel, Esq.; Daniel Law Offices, P.A.

(57) ABSTRACT

A personal protective mask includes a mask body having an expandable section that is positioned between the top and bottom ends of the mask. An adhesive material is positioned on the inside surface of the mask along the outer periphery. The adhesive includes skin safe adhesive for creating an air tight seal between the mask and the face of a wearer. The mask includes a nose clip, a sweat band and at least one headband. The mask is constructed in accordance with N95 standards, and the expandable section transitions between a contracted and expanded state, to conform to the movements of the user's jaw. The expandable section includes two folds and a middle section. The folds move linearly about each other so as to prevent deformation of the mask outward from the user's face.

16 Claims, 5 Drawing Sheets

(56) References Cited

U.S. PATENT DOCUMENTS

| | | | | |
|---|---|---|---|---|
| 2009/0078261 | A1 | 3/2009 | Martin et al. | |
| 2009/0277451 | A1 | 11/2009 | Weinberg | |
| 2011/0061656 | A1 | 3/2011 | Matich | |
| 2011/0067701 | A1 | 3/2011 | Duffy | |
| 2012/0060843 | A1* | 3/2012 | Magidson | A41D 13/1146 128/206.19 |
| 2017/0100503 | A1* | 4/2017 | Yamada | A41D 13/1192 |
| 2017/0360125 | A1* | 12/2017 | Tuan | A41D 13/1115 |
| 2018/0154195 | A1* | 6/2018 | Henderson | A62B 23/025 |

* cited by examiner

PERSONAL PROTECTIVE MASK

CROSS-REFERENCE TO RELATED APPLICATIONS

This application claims the benefit of U.S. Application Ser. No. 62/652,961 filed on 5 Apr. 2018, the contents of which are incorporated herein by reference.

TECHNICAL FIELD

The present invention relates generally to masks, and more particularly to a personal protective mask.

BACKGROUND

The statements in this section merely provide background information related to the present disclosure and may not constitute prior art.

Disposable personal protective masks, also referred to as "respirators" or "filtering face masks" have long been provided to be worn over the breathing passage(s) of a person's face. The two most common uses for these types of masks are: (1) to prevent impurities or contaminants from entering the wearer's breathing passage, and (2) to protect others from being exposed to pathogens or other contaminates exhaled by the wearer.

In the first situation, the mask is worn in an environment where the air contains particles harmful to the wearer, for example, doctors working with sick patients and blue-collar workspaces where fine particulates are present (e.g., painters, mills, auto body shops, etc.). In the second situation, the mask is worn in an environment where there is a high risk of the wearer infecting others, for example, a sick person in a waiting room or a crowded work space.

Although most disposable respirator masks are manufactured under the N95 designation, which means that theoretically the mask can block 95 percent of small (0.3 micron) particles, real world tests have proven the actual filtration amount is closer to 61 percent. The primary cause for this reduction in efficiency is related to the way the mask fits onto the user's face.

In this regard, conventional respirator masks utilize one or more straps as the only means for securing the mask to the user. Unfortunately, the pulling force imparted by the straps are not evenly distributed along the mask body, thus allowing air gaps to form between the periphery of the mask and the user's face. Additionally, because of the fixed shape of the mask, articulation of the user's jaw when speaking causes the mask to bend outward and away from the user's face. This deformation exacerbates the size and number of air gaps, and also increases the total space (typically 100 ml) between the mask and the user's face. Tests have shown this increase to often exceed 300 ml thus creating a large "dead space" where CO2 remains and is subsequently inspired by the user.

Accordingly, it would be beneficial to provide a personal protective mask having a shape that can actively adjust to match movements of the user, and that includes an improved sealing mechanism so as to overcome the drawbacks described above.

SUMMARY OF THE INVENTION

The present invention is directed to a personal protective mask. One embodiment of the present invention can include a mask body having an expandable section that is positioned between the top and bottom ends of the mask. An adhesive material is positioned on the inside surface of the mask along the outer periphery, and functions to create an air tight seal between the mask and the face of a wearer. Optional nose clip, sweat band and headbands are provided to increase use and comfort.

The mask can be constructed in accordance with N95 standards, and the expandable section can transition between a contracted and expanded state, so as to allow the bottom end of the mask to move with the movements of a user's jaw. The expandable section can include two folds that move linearly about the other, so as to ensure the mask does not deform outward from the user's face.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
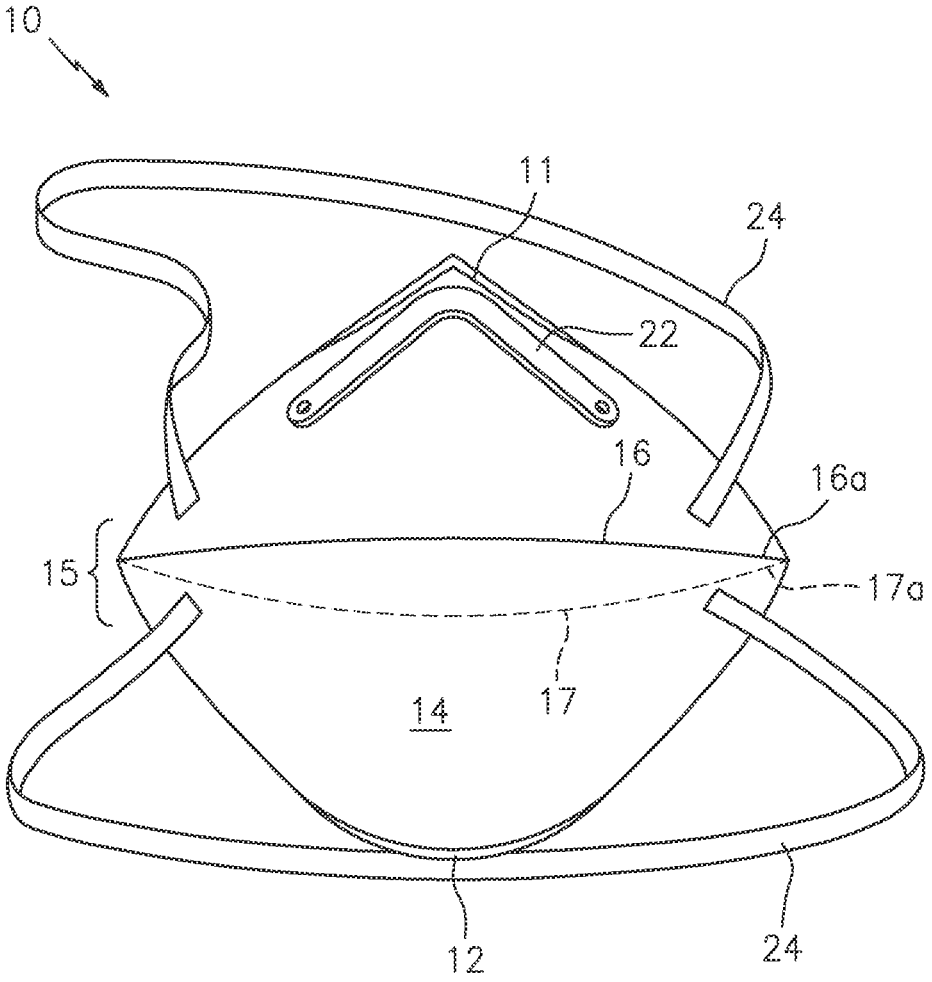
FIG. 1A is a frontal view of the personal protective mask in the closed orientation, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

FIGS. 1A-3B illustrate one embodiment of a personal protective mask 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown, the mask 10 can include a main body having a top end 11, a bottom end 12, an inside facing surface 13, an outside facing surface 14 and a resilient expandable section 15. In the preferred embodiment, the mask body can be constructed from cotton that is overlaid with plastic and/or other materials, as are known in the art to achieve the government standard N95 efficiency rating. However other embodiments are contemplated wherein different construction materials may be utilized to achieve this or other efficiency ratings.

Figure 1B:
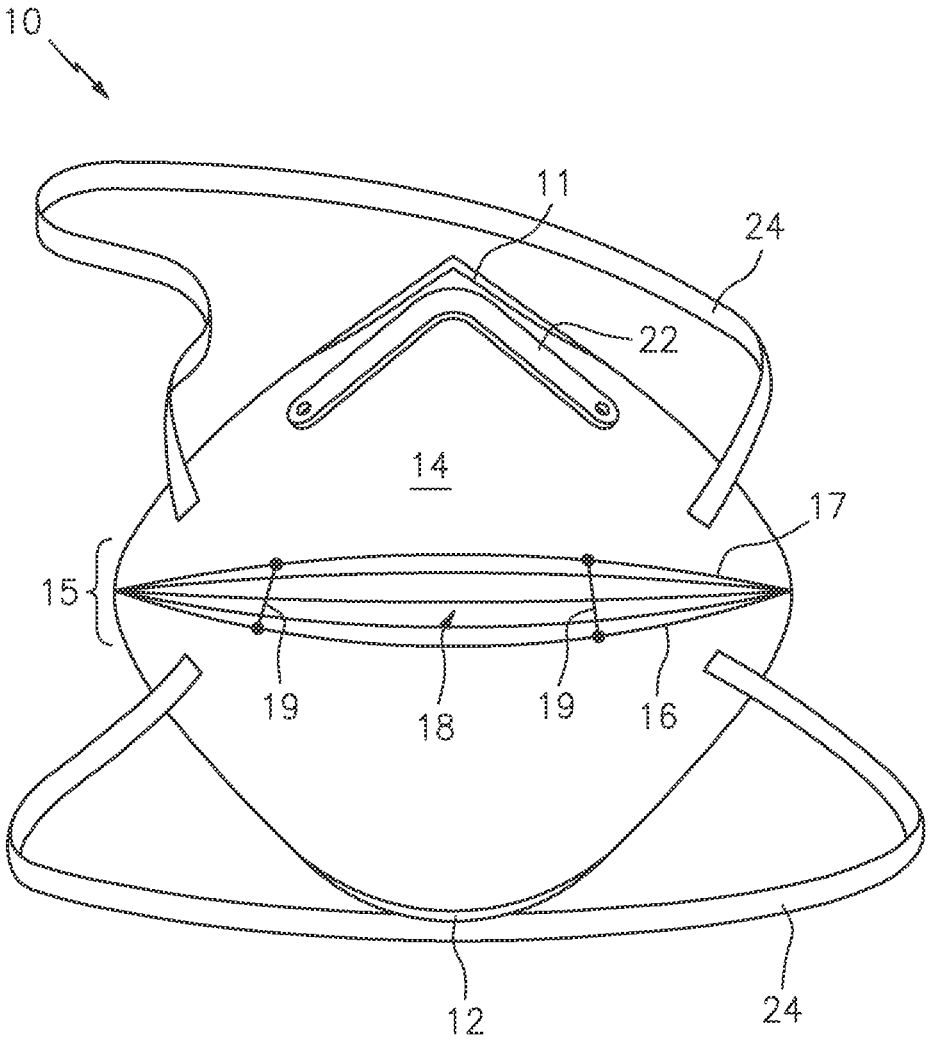
FIG. 1B is a frontal view of the personal protective mask in the open orientation, in accordance with one embodiment of the invention.
Figure 2A:
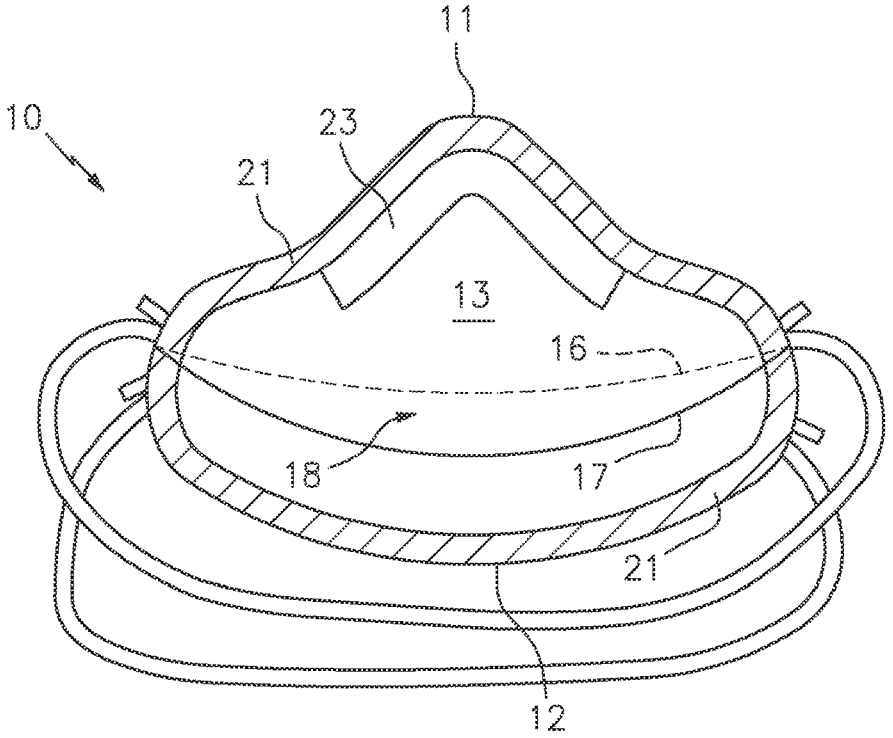
FIG. 2A is a rear view of the personal protective mask in the closed orientation, in accordance with one embodiment of the invention.
Figure 2B:
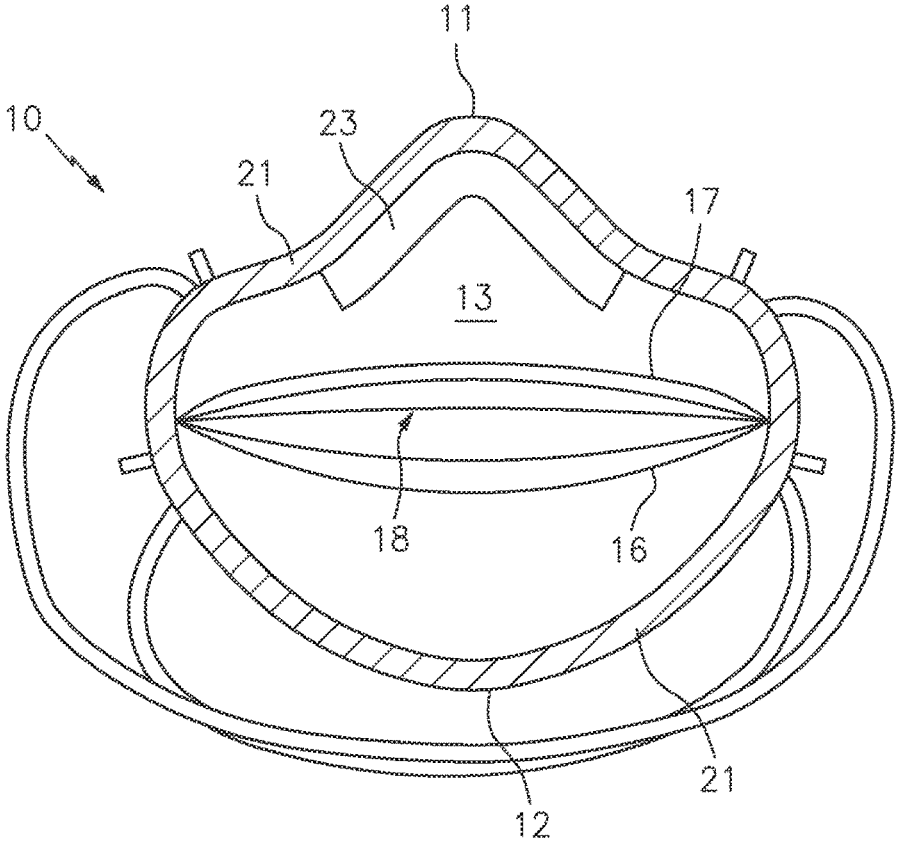
FIG. 2B is a rear view of the personal protective mask in the open orientation, in accordance with one embodiment of the invention.
Figure 3A:
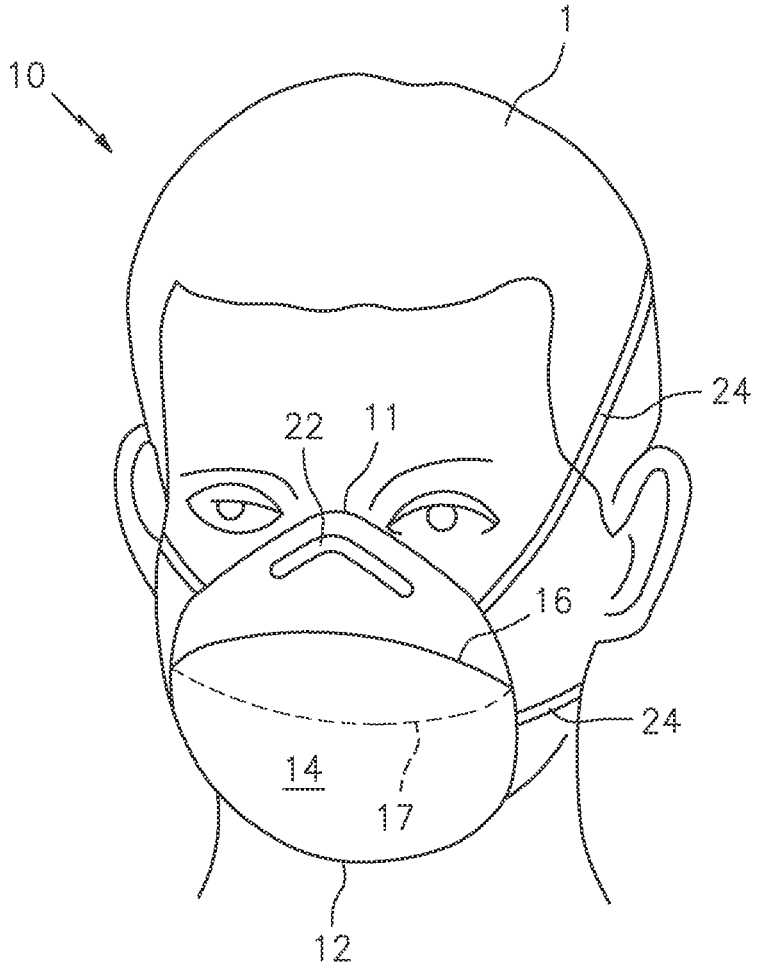
FIG. 3A is a perspective view of the personal protective mask in operation, in accordance with one embodiment of the invention.
Figure 3B:
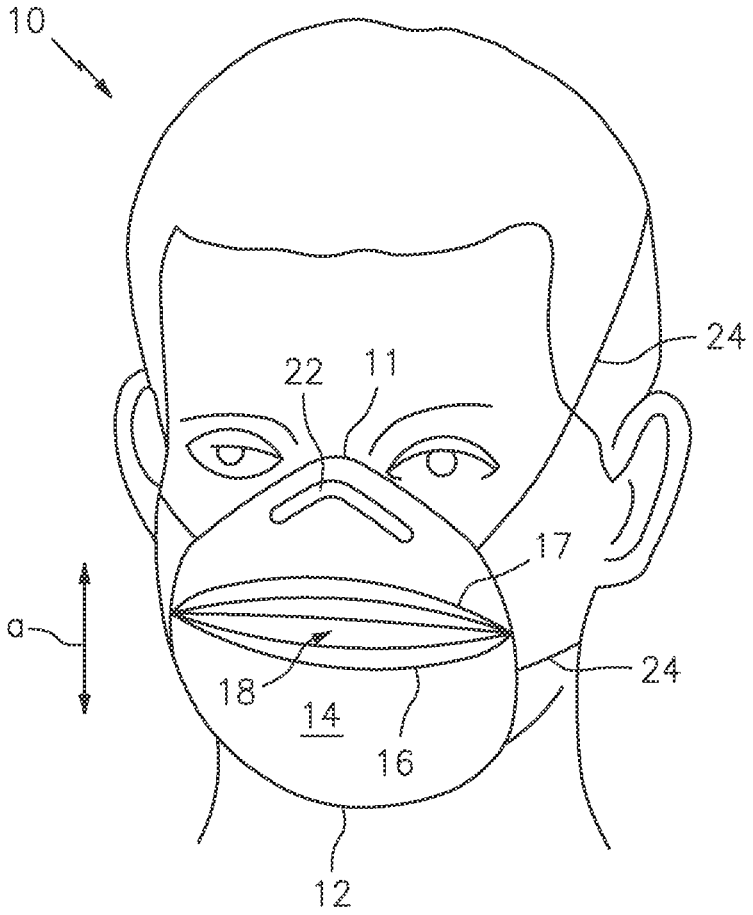
FIG. 3B is another perspective view of the personal protective mask in operation, in accordance with one embodiment of the invention.

The expandable section 15 can transition from the contracted/folded orientation shown in FIGS. 1A, 2A and 3A to the expanded/unfolded orientation shown in FIGS. 1B, 2B, and 3B. In this regard, the expandable section 15 is designed to allow the shape of the mask body to conform to the shape of a user's face at all times. As will be described below, this feature means that as a user talks, the expandable section of the mask can extend and contract thereby allowing the bottom end of the mask 12 to move up and down in conformity with the movement of the user's jaw, while keeping the upper end 11 stationary. This movement also does not affect the distance between the inside facing surface of the mask 13 and the user's face.

In one embodiment, the expandable section can include a first fold line 16, a second fold line 17 and a middle section 18. The fold lines can preferably be heat formed along the mask body with the distal ends 16*a* and 17*a* joined together. The lines are formed such that the resting position of the mask is in the collapsed position, where the first fold line is located above the second fold line, and the middle section is positioned behind the front facing material of the mask extending from the first fold line 16 and the top of the mask 11. Conversely, when the mask is in the extended position, the first fold line 16 is located below the second fold line 17, and the middle section 18 is exposed.

In one embodiment, one or more resilient retention members 19 can be disposed along the expandable section 15. The retention members can include any number of different materials that can provide a tensioning force onto the mask body to assist in maintaining and/or returning to the collapsed orientation. In the preferred embodiment, the retention members can include a plurality of elastomeric stitches that are secured to or between the first- and second-fold lines of the mask body. Of course, other embodiments are contemplated wherein different materials such as a spring, for example, are used and/or wherein the retention member(s) are secured differently.

In one embodiment, an adhesive material 21 can be disposed along the inside facing surface of the mask 13 at the outer periphery. The adhesive can function to create an airtight seal between the outer periphery of the mask and the face of the user, so as to ensure air only passes through the mask material and not from any gaps along the periphery. In the preferred embodiment, the adhesive material can comprise medical grade skin tape having a removable film (not illustrated); however, any type of commercially available adhesives and/or tapes that are suitable for prolonged exposure to human skin are also contemplated.

In various embodiments, the mask can include additional features such as an adjustable-shaped nose clip 22, a moisture wicking strip 23, and/or one or more head straps 24. To this end, the nose clip 22 can be constructed from a malleable material such as aluminum, the strip 23 can be constructed from polyester, and the head strap(s) 24 can be constructed from an elastomeric material such as nylon bands, for example. Of course, other embodiments are contemplated wherein different construction materials are utilized.

In operation, the mask 10 can be secured to a user 1 by positioning the mask over the nose and mouth of the user and then securing the periphery of inside facing portion of the mask body 13 to the user's face via the adhesive tape 21. At this time, the head strap(s) 24 can be secured about the head of the user to act as a secondary means of support, and the nose clip 22 can be adjusted to fit the shape of the user's nose. Accordingly, by securing the mask to the user's face with the adhesive tape, the mask advantageously eliminates the problematic air gaps along the periphery and ensures a complete seal to the user's face.

As shown in FIGS. 3A and 3B, the convex nature of the folds 16 and 17 allow the central portion of the mask to expand and contract so as to allow the bottom end 12 of the mask to move up, down, left, right, in and out, in harmony with the movement of the user's jaw. To this end, because the folds of the expandable section move up and down in a sliding motion (see arrow a), the mask does not deform and create the dead space experienced by other masks. Such a feature ensures the mask maintains approximately 100 ml of total space between the inside surface and the user's face at all times, regardless of the movement of the user's mouth.

Accordingly, a personal protective mask 10 that is constructed as described herein can provide superior protection to a user in any environment that approaches or meets the bench standards of the N95 designation at all times.

As described herein, one or more elements of the mask 10 can be secured together utilizing any number of known attachment means such as, for example, glue, and compression fittings, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A personal protective mask, comprising:

a main body having a top end, a bottom end, an inside surface, an outside surface, a middle section, and an outer periphery;

an adhesive material that is disposed along the inside surface of the body along the outer periphery;

an expandable section that is positioned along the middle section of the main body, said expandable section including a plurality of folds that transition between an expanded orientation and a contracted orientation;

an upper non expandable section that is positioned between the middle section and the top end;

a lower non expandable section that is positioned between the middle section and the bottom end; and a resilient retention member that is in communication with the main body only along the expandable section, said resilient retention member functioning to bias the expandable section in the contracted orientation.

2. The mask of claim 1, wherein the main body comprises an N95 filtration rating and includes a shape and size that is suitable for engaging a face of a user.

3. The mask of claim 1, wherein the adhesive material comprises:

adhesive skin tape.

4. The mask of claim 1, further comprising:

a nose clip that is positioned along the outside surface of the main body.

5. The mask of claim 4, wherein the nose clip is constructed from a malleable material and includes an adjustable shape.

6. The mask of claim 1, further comprising:

a moisture wicking strip that is positioned along the inside surface of the main body.

7. The mask of claim 1, further comprising:

at least one head strap that extends outward from the outer periphery of the main body.

8. The mask of claim 1, wherein the resilient retention member includes at least one elastomeric stitch that is in communication with the plurality of folds of the expandable section.

9. The mask of claim 1, wherein the resilient retention member includes a plurality of elastomeric stitches that are in communication with the plurality of folds of the expandable section.

10. The mask of claim 1, wherein the expandable section is formed integrally with the main body.

11. The mask of claim 10, wherein the expandable section and the main body are constructed from a single piece of material.

12. The mask of claim 1, further comprising:

a nose clip that is positioned along the main body, said nose clip having a first end and a second end, wherein the resilient retention member includes a pair of elastomeric stitches that are in communication with the plurality of folds of the expandable section, and that are positioned away from the outer periphery of the main body and adjacent to a center portion of the main body, wherein one of the pair of elastomeric stitches is located directly beneath the first end of the nose clip, and the other of the pair of elastomeric stitches is located directly beneath the second end of the nose clip.

13. The mask of claim 1, wherein the plurality of folds of the expandable section comprise:

a first fold, a second fold, and a plurality of intervening folds.

14. The mask of claim 13, wherein in the contracted orientation the first fold is positioned above the second fold, and the plurality of intervening folds are positioned behind first fold, and in the expanded orientation, the first fold is positioned below each of the second fold and the plurality of intervening folds.

15. The mask of claim 14, wherein the resilient retention member includes a pair of elastomeric stitches that are in communication only with the first fold and the second fold.

16. The mask of claim 1, wherein the main body maintains at least 100 ml of space between the inside surface and a users face in both the expanded orientation and the contracted orientation.

* * * * *